US007090531B2

(12) United States Patent
Simmel

(10) Patent No.: US 7,090,531 B2
(45) Date of Patent: Aug. 15, 2006

(54) PLUG-CONNECTION VERIFICATION FOR DETECTING A PROPERLY MADE ELECTRICAL PLUG CONNECTION

(75) Inventor: Andreas Simmel, Schwaikheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/733,428

(22) Filed: Dec. 11, 2003

(65) Prior Publication Data

US 2004/0166725 A1 Aug. 26, 2004

(30) Foreign Application Priority Data

Dec. 24, 2002 (DE) ..... 102 61 016

(51) Int. Cl.
*H01R 3/00* (2006.01)

(52) U.S. Cl. ..... 439/489; 439/490

(58) Field of Classification Search ..... 439/489, 439/490, 911

See application file for complete search history.

(56) References Cited

U.S. PATENT DOCUMENTS 5,112,246 A * 5/1992 Kawase et al. ..... 439/489
5,120,255 A * 6/1992 Kouda et al. ..... 439/489
5,222,164 A 6/1993 Bass, Sr. et al. ..... 385/14
5,686,897 A * 11/1997 Loh ..... 340/649
6,784,802 B1 * 8/2004 Stanescu ..... 340/687

FOREIGN PATENT DOCUMENTS

DE 100 13 864 10/2001
EP 440 330 8/1991

* cited by examiner

*Primary Examiner*—Javaid H. Nasri
(74) *Attorney, Agent, or Firm*—Kenyon & Kenyon LLP

(57) ABSTRACT

A plug-connection verification system for detecting a properly made electrical plug connection. A detection device is provided which includes an analyzer unit and a data transmission device, the analyzer unit being designed to detect the position of the locking element and the data transmission device being designed to transmit the determined position of the locking element.

5 Claims, 2 Drawing Sheets

PLUG-CONNECTION VERIFICATION FOR DETECTING A PROPERLY MADE ELECTRICAL PLUG CONNECTION

FIELD OF THE INVENTION

The present invention relates to a plug-connection verification for detecting a properly made electrical plug connection between a plug having a locking element and a socket.

BACKGROUND INFORMATION

Plug connections which are composed of a plug and a socket as well as a locking element securing the plug connection, are available in many designs. Such plug connections are used, in particular, in the automotive industry. These plug connections are plugged together by operators during the assembly process on the assembly line. Generally, no provision is made to verify whether the plug connection has been properly made.

There are different ways to verify whether such plug connections have actually been plugged together properly and completely. Conventionally, a plug connection is designed in such a manner that, by visual inspection, for example through a cover element, it is possible to see whether or not the electrical plug connection has been properly made.

In the automotive industry, for example, plug connections generally have to be made at locations that are very difficult to see. This involves the disadvantage that conventional visual inspections cannot be used here, because the operator must make the plug connection "blindly" and therefore has no possibility to carry out a visual inspection.

It is only upon the completion of all electrical plug connections that the defect is possibly detected. However, due to the multitude of plug connections, the faulty connections can no longer be detected or only with greater effort.

An object of the present invention is to provide a plug-connection verification which allows a connection that has already been plugged together to be checked for correctness without the plug connection being accessible to view.

SUMMARY

In accordance with the present invention, a plug-connection verification is provided in such a manner that the state of the plug connection is transmitted to a stationary or mobile receiver element by data transmission so that the operator has the possibility of verifying the plug connection with the aid of this receiver element.

In an embodiment, a detection device is provided which includes, an analyzer unit and a data transmission unit, the analyzer unit being designed to detect the position of the locking element and the data transmission unity being designed to transmit the detected position of the locking element.

The present invention is suitable as a verification system, in particular, for monitoring plug connections in the case of plug connections in automobiles during vehicle assembly. Every plug-connector housing, independently of whether it has a large or a small number of pins, can be proposed for use for the device according to the present invention.

It is also possible to retrofit conventional plug connections with the device according to the present invention so that there is no need to redesign plugs and sockets that already have a very complex design.

Advantageously, the plug-connection verification system, which include, the detection device, is arranged on a microchip which, for example, is adhesively bonded to the plug-connector housing or fixed in a recess provided in the plug-connector housing.

An analyzer unit carries out the analysis of whether or not a plug connection has been properly made.

This analyzer unit has the task of determining the position of the locking element, namely with respect to the position assumed by the locking element before it is slipped onto the socket. As the locking element is slipped on, its free end lifts, releasing, for example, a contact element which forms part of the analyzer unit. This signal, in turn, is passed on to a data transmission device and indicates that the plug connection has been properly made.

An alternative embodiment is to optically scan the position of the locking element. Further detection of the position of the locking element can be accomplished using conventional means.

Preferably, the data transmission device transmits the signal to a receiver unit. The receiver unit is arranged externally, that is, outside the reach of the plug connection. This receiver unit can emit a signal from which the operator can infer whether or not the plug connection has been properly made.

As an advantageous further development, provision is made for the receiver unit to be arranged on the wrist of the operator (in a manner comparable to a watch). Due to this arrangement, the operator is informed whether or not the plug connection has been properly made immediately during the plugging operation. In case he or she misses a signal, this receiver unit preferably stores the corresponding coordinates of the plug and forwards this error message to a central unit so that, during intermediate or final inspection, it is possible without a great deal of effort to determine which plug connection has not been properly made.

Advantageously, it is also possible to create a certification record recording the quality of the plug connections made.

DETAILED DESCRIPTION OF EXAMPLE EMBODIMENTS

Figure 1:
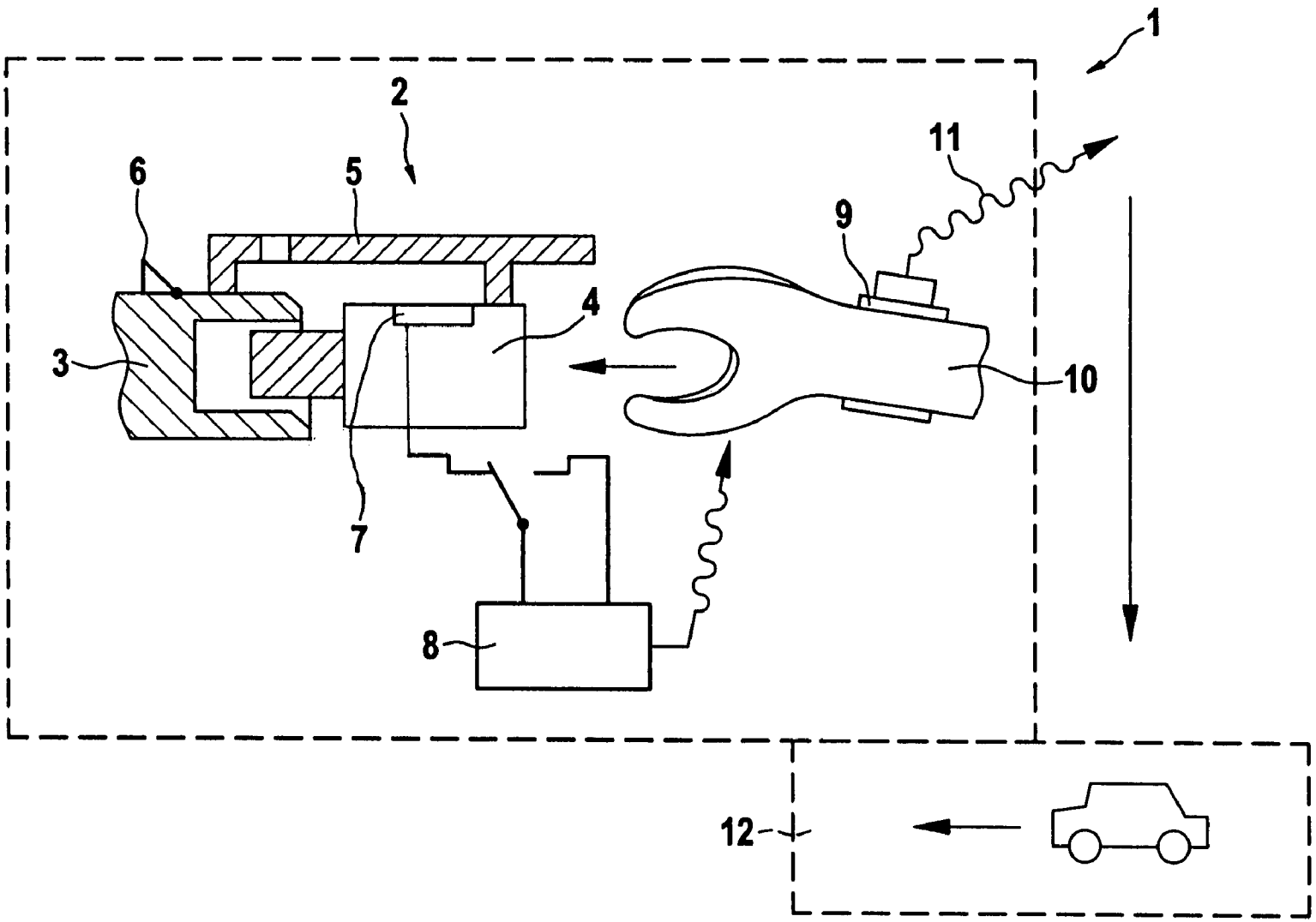
FIG. 1 shows a schematic representation of a plug-connector verification in accordance with the present invention, during a work process.

FIG. 1 shows a plug connection verification 1 for detecting a properly made electrical plug connection 2. Electrical plug connection 2 is composed of a socket 3 and a plug 4. Arranged on plug 4 is a locking element 5 which, when in the locked position, grips behind a nose 6 arranged on the side of socket 3, thus ensuring a vibration-proof plug connection.

When the plug connection is in the plugged state, then analyzer device 7 (which is formed on a microchip for fixed connection to the plug 4) detects the state of plug connection 1 and triggers a signal which is transmitted to a data transmission device 8, e.g., a transponder.

In the example embodiment shown here, the data transmission device preferably sends the acknowledgment of the properly executed plugging operation to a further receiver element 9, along with an identification of the plug connection. This receiver element 9 is preferably arranged on a wrist 10 of the employee. Based on the state indicated on receiver element 9, the operator can see the quality of the plug connection immediately upon completion of the plugging operation. In case he or she is not able to recognize or interpret the signal, then this acknowledgment is forwarded 11 to a central control unit 12 along with the identification of the plug connection. This central control unit 12, in turn, manages the corresponding plug connections and outputs the error messages at arbitrary points of the work process to make a correction.

Figure 2A:
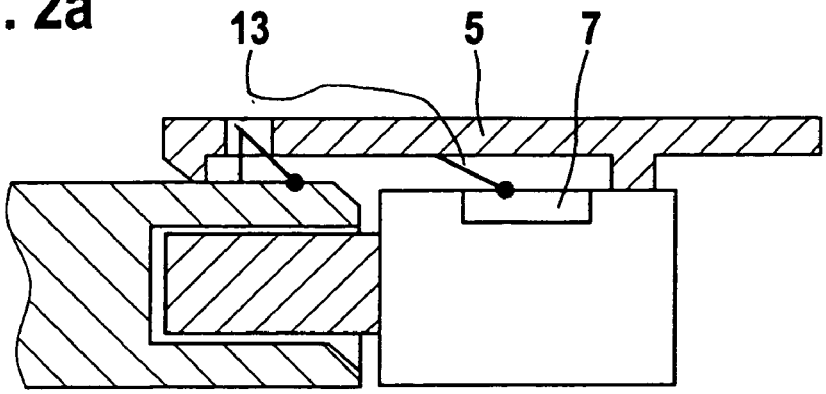
FIG. 2A shows a schematic representation of an embodiment of a plug-connector verification for a plug having a locking element in a plugged position.
Figure 2B:
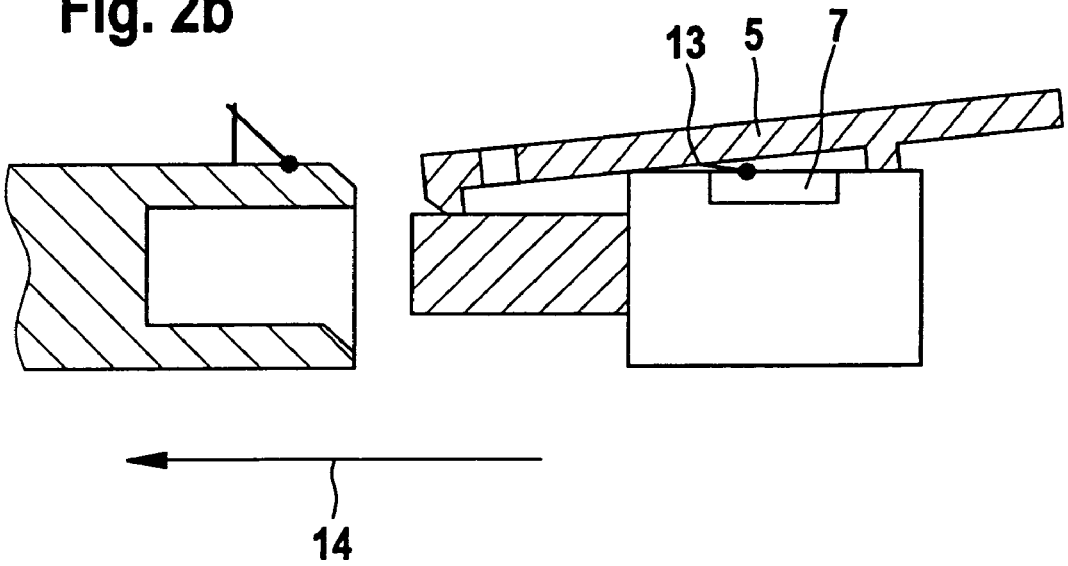
FIG. 2B shows a schematic representation of an embodiment of a plug-connector verification for a plug having a locking element in a non-plugged position.

FIGS. 2A and 2B show the principle of an analysis of the plug connection. FIG. 2B shows the plug connection while in the unplugged state. In this position, locking element 5 operates a switch 13 which is designed as part of analyzer unit 7. By moving the plug in the direction of arrow 14, the locking element opens and releases switch 13 as shown in FIG. 2A. Subsequently, the signaling process already described in FIG. 1 takes place to transmit the corresponding signal to the operator.

Figure 3:
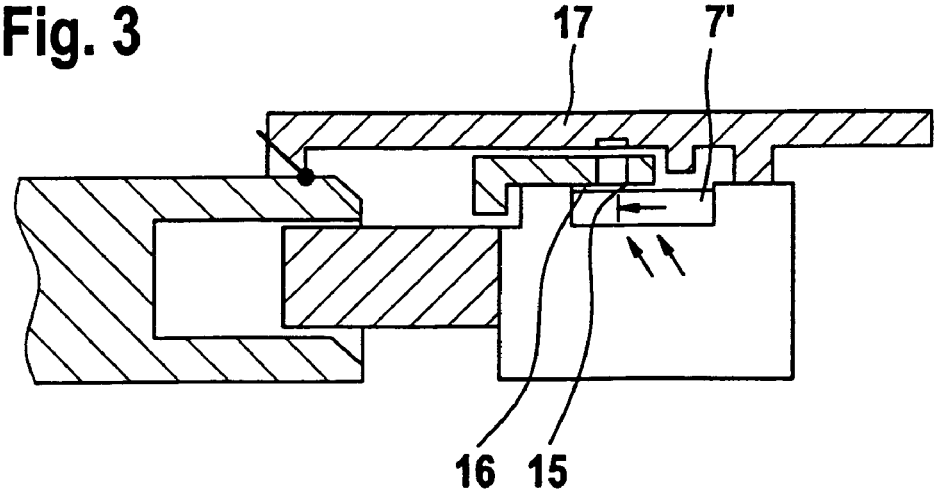
FIG. 3 shows an alternative embodiment of the plug connector verification depicted in FIG. 2A in a non-plugged position.

FIG. 3 depicts an alternative embodiment. The analyzer unit 7' shown here includes a light-emitting diode 15, which is covered in the non-locked state. As soon as the plug connection is made, an opening 16 is cleared and a photovoltaic cell 17 (not specifically shown in FIG. 3) is exposed to light. This photovoltaic cell 17, in turn, emits a corresponding signal to data transmission device 8, thus indicating that the electrical plug connection has been completed.

What is claimed is:

1. A plug-connection verification system for detecting a properly made electrical plug connection between a plug having a locking element and a socket, comprising:

a detection device including an analyzer device and a data transmission device, the analyzer unit being configured to detect a position of the locking element and the data transmission device being configured to transmit the determined position of the locking element, wherein the detection device is arranged on a chip element that is fixedly connected to the plug; and a receiver unit configured to receive data from the data transmission device, wherein the receiver unit is configured to be attached to a wrist of an operator.

2. The plug-connection verification system as recited in claim 1, further comprising:

a switch arranged below the locking element.

3. The plug-connection verification system as recited in claim 1, wherein the locking element has an opening through which a light-emitting diode emits radiation onto a photovoltaic cell when the locking element is in a defined position.

4. The plug-connection verification system as recited in claim 1, wherein the detection device includes a transponder.

5. The plug-connection verification system as recited in claim 1, wherein:

the receiver unit includes a memory for storing an indication of the determined position.

* * * * *